US005469675A

United States Patent [19]

Arteon

[11] Patent Number: 5,469,675

[45] Date of Patent: Nov. 28, 1995

[54] ANCHORING PIECE, IN PARTICULAR FOR CONCRETE

[76] Inventor: Marcel Arteon, 16, rue Cino del Duca, FR-92200 Neuilly sur Seine, France

[21] Appl. No.: 17,969

[22] Filed: Feb. 12, 1993

Related U.S. Application Data

[63] Continuation of Ser. No. 487,976, filed as PCT/FR89/00365, Jul. 10, 1989, abandoned.

[30] Foreign Application Priority Data

Jul. 11, 1988 [FR] France ..... 88 09386

[51] Int. Cl.[6] ..... E04G 21/14

[52] U.S. Cl. ..... 52/125.5; 52/127.5; 52/706

[58] Field of Search ..... 52/125.2, 125.5, 52/125.1, 125.3, 125.4, 126.1, 127.5, 225, 226, 706, 707, 711

[56] References Cited

U.S. PATENT DOCUMENTS

| | | | |
|---|---|---|---|
| 2,772,560 | 12/1956 | Neptune | 52/125.4 X |
| 2,886,370 | 5/1959 | Liebert | 52/125.4 X |
| 3,003,217 | 10/1961 | Gerwick, Jr. | 52/225 X |
| 3,106,803 | 10/1963 | McRobbie | 52/125.5 X |
| 3,420,014 | 1/1969 | Courtois et al. | 52/125.4 X |
| 3,431,012 | 3/1969 | Courtois et al. | 52/125.4 X |
| 3,861,106 | 1/1975 | Erhart | 52/125.4 X |
| 4,014,151 | 3/1977 | Erhart . | |
| 4,179,151 | 12/1979 | Tye | 52/125.5 X |
| 4,290,638 | 9/1981 | Manning | 52/125.5 X |
| 4,634,164 | 1/1987 | Fricker | 52/125.5 X |

FOREIGN PATENT DOCUMENTS

| | | | |
|---|---|---|---|
| 0001095 | 3/1979 | European Pat. Off. . | |
| 0259295 | 3/1988 | European Pat. Off. . | |
| 2072873 | 9/1971 | France . | |
| 1961879 | 6/1971 | Germany | 52/125.5 |
| 2223519 | 11/1973 | Germany | 52/125.4 |
| 2304040 | 8/1974 | Germany | 52/125.5 |
| 2741674 | 3/1979 | Germany | 52/125.4 |
| 3202774 | 8/1983 | Germany . | |

*Primary Examiner*—Lanna Mai
*Attorney, Agent, or Firm*—Eckert Seamans Cherin & Mellott

[57] ABSTRACT

An anchoring piece for hardenable material such as concrete or plaster, comprising a grasping shank and a base of larger cross-section than that of the shank. The base (3) includes at least one support strip (5) whose top is hollowed out and intended to hold a reinforcing iron or bar (4) so as to fix together the assembly constituted by the anchoring piece and the reinforcing bar.

7 Claims, 4 Drawing Sheets

ANCHORING PIECE, IN PARTICULAR FOR CONCRETE

This is a continuation-in-part of application Ser. No. 07/487,976, filed as PCT/FR89/00365 Jul. 10, 1989, now abandoned The present invention relates to an anchoring piece for a hardener material, and in particular for concrete, the piece being intended to be included in part inside a concrete element with the other part of the piece remaining outside the element to enable it to be handled. The invention relates particularly, but not exclusively, to an anchoring piece intended to be inserted in thin panels such as those which are to be found in prefabricated buildings.

The problem which is solved by the present invention is that of obtaining a point enabling traction forces (e.g. lifting forces) to be exerted on an element obtained by casting a material that is capable of hardening (concrete, plaster, etc. . . . ). Several solutions have already been proposed for concentrating traction forces on the anchoring point by making use of an elongate element or shank having grasping means at its top end and anchoring means at its bottom end. A known type of anchor is shown in FIG. 1. It comprises a head A, a shank B, and a base C which is larger in diameter than the shank. This insert applies compression forces to the element, i.e. the traction force is applied to the base of the anchor, thereby defining an extraction cone. Another known solution comprises an eye anchor such as that shown in front view in FIG. 2, likewise having a head A, a shank B, and a base D, with the base this time having an opening E through which a reinforcing bar is passed. Such an anchor fixes the head A to a reinforcing iron or bar which passes through the eye E. The traction force is conveyed to the mass of the panel, in this case because of the adherence between the bars and the inside of the panel.

Other anchors are also used, in particular so-called "fishtail" anchors where the shank is terminated at its base end by a "fishtail" with the top end of the anchor having a hole, for example, for receiving the hook of a hoist, or else a threaded shank or a tapped tube. The fishtail constitutes a tab which is sealed within the material. However, all known anchor means suffer from drawbacks or limits on their use, in particular in association with thin panels.

When used in compression, as shown in FIG. 3, the extraction cone cannot be formed appropriately and flaking F is sometimes observed if the element is thin, or at least cracks are observed near the connection.

When using an eye anchor, as shown in FIG. 4, the reinforcing iron G is deformed and crushed while a lifting force is being applied, thereby changing its curvature, thus straining it and possibly breaking it.

EP-A-0 259 295 describes an anchor in which an eye is provided in the anchor head. In order to facilitate passing a curved bar therethrough, the bottom inside surface of the hole is slightly curved. However the armature does not bear against the bottom of said orifice.

FR-A-2 072 873 relates to a cylinder of plastic material, for example, intended to receive a metal pin and reinforcing irons penetrating inside hollows formed in the body of the cylinder. However there is no direct connection between the pin and the reinforcing irons. Further, the sleeve occupies a larger concrete-free volume, and this presents problems with thin panels. It can only be used with reinforcing bars.

The object of the present invention is to mitigate the above-mentioned drawbacks and to provide an anchor which is universal in nature making it possible to work either by compression alone, or else by compression and by adherence, and which may be shorter in length than conventional anchors.

According to the present invention an anchoring piece for hardenable material, the piece comprising: a portion remaining outside the material and intended to be grasped; a shank having an axis of symmetry; and a base having larger dimensions than the shank; is characterized in that the base includes at least one support and guide strip for a reinforcing iron, the strip being hollowed out in its top face.

The bar is thus held in position by the edges of the strip and cannot slide during molding. The section of the strip is circular and the diameter of the grooves is substantially equal to the diameter of the reinforcing irons so that the irons bear against the inside of the strip in optimum manner.

According to another characteristic of the invention, the base of the shank is pierced by at least one eye extending in a direction substantially perpendicular to the axis of the shank, the top surface of the base forming a curved support strip extending the eye opening.

In another embodiment, the, or each, strip is off-center relative to the axis of the shank. A single anchor base can thus engage two or more reinforcing irons.

An anchor of the invention may be used either without a reinforcing iron, with the material of the element working in compression, or else with a reinforcing iron supported by the inside of the strip, thereby providing appropriate mechanical transmission for the forces applied to the anchoring piece, e.g. during handling.

The reinforcing iron is not deformed or damaged and the implant does not move relative to the reinforcing iron, thereby avoiding cracks appearing at the connection.

Other characteristics and advantages of the invention appear from the following description of particular embodiments, given purely byway of non-limiting example and with reference to the accompanying drawings, in which.

Figure 1:
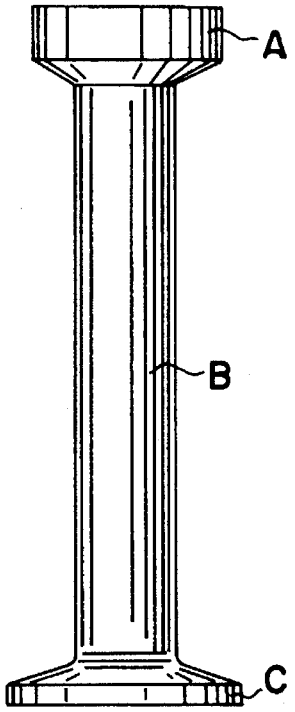
FIGS. 1 to 4 are diagrams showing prior art anchors and their drawbacks.
Figure 2:
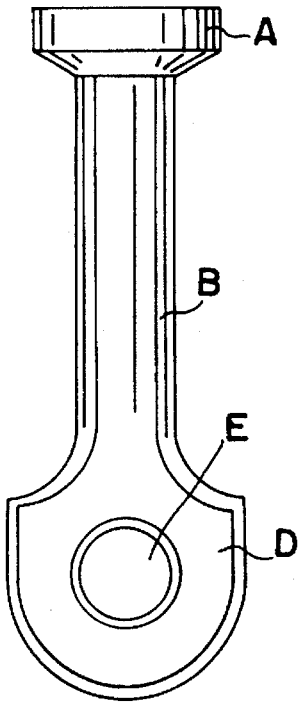
Figure 3:
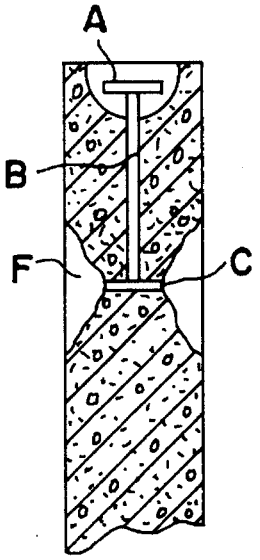
Figure 4:
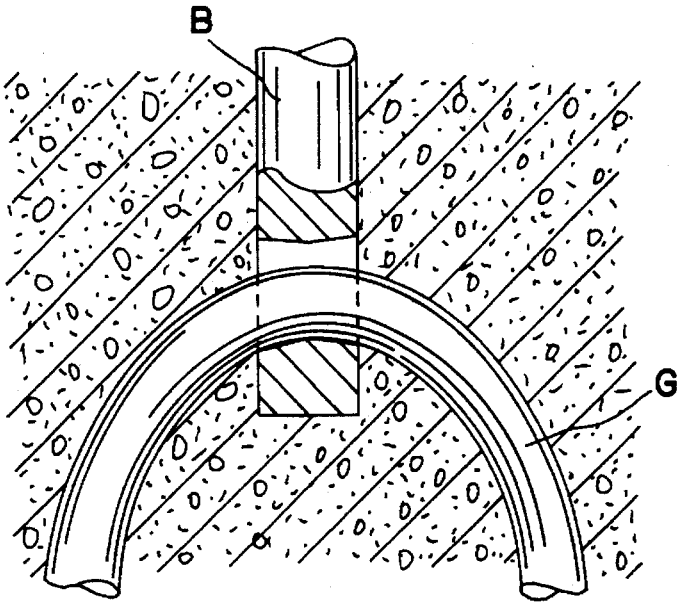
Figure 5:
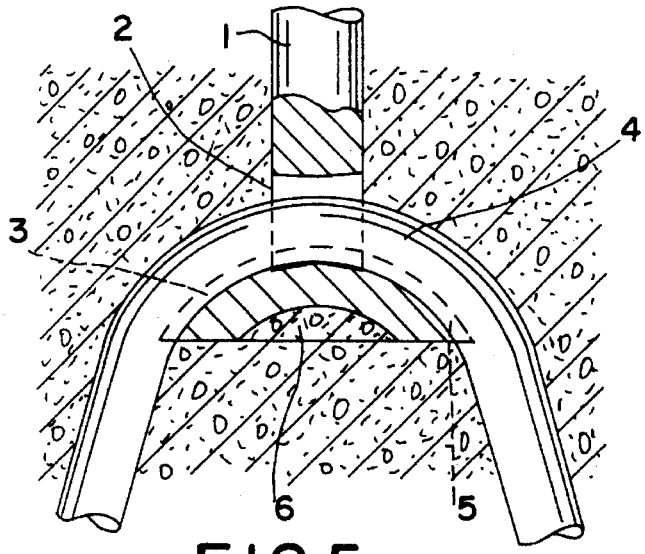
FIG. 5 is a section view through the bottom portion of an anchor of the invention.

FIG. 5 shows the bottom end of an implant 1 which is constituted in the example shown by a cylindrical shank pierced by an eye 2 and terminated immediately beneath the eye 2 by a base 3. A reinforcing iron 4 passes through the eye, which iron is inserted during assembly in a support strip or groove 5 within which the iron is securely guided and held. The base 3 may be partially hollowed out as shown at 6. The anchor head (not shown) maybe of any type and enables the anchor to be grasped by an appropriate hoisting machine. It can thus be observed that an anchor of the present invention, when a reinforcing bar is passed through the eye 2, operates simultaneously both by compression and by adherence to the concrete, or more generally to the substance from which the element is made. This gives rise to a uniform assembly, thereby increasing the load that can be carried by a given volume of insert. The resulting strength is greater than the sum of either strength (compression or adherence) considered in isolation. The structure of the piece eliminates the rocking play that previously existed in eye anchors, thereby eliminating any danger of cracking. Force is applied to the reinforcing iron 4 over a certain length thereof so it no longer operates in bending or shear, as is the case in prior eye anchors. In a thin panel, this embodiment avoids the panel being damaged in the way shown in FIG. 3.

Figure 7:
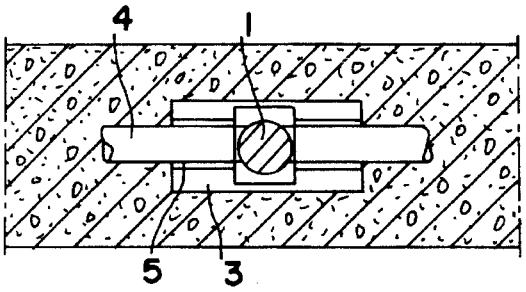
FIG. 7 is a plan view corresponding to the embodiment of FIG. 5.

FIG. 7 is a plan view of the device shown in FIG. 5, and it can be seen that the iron 4 is securely guided by the strip 5.

Figure 6:
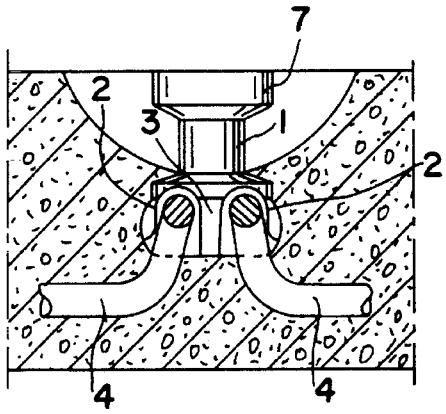
FIG. 6 is a vertical section through a second embodiment connected to two reinforcing bars for implanting purposes.

As shown in FIG. 6, in order to improve the connection, two or more reinforcing irons 4 may be passed through the base 3 of the anchor. The eyes 2 are then formed in the base 3. Thus, for the same total force, the diameter of the reinforcing bars may be reduced, thereby considerably reducing their radius of curvature and facilitating the provision of the support strips. In FIG. 6, the head 7 of the anchor extends downwards in the form of a short shank 1 which is terminated by a base 3 provided with two openings 2, and the support strips may be sloping in this case. When the length of the implant provided with support strips and one or more orifices for reinforcing irons is sufficient relative to the physical characteristics of the substance from which the element is made, it is possible to omit the reinforcing irons, with the support strips 5 then providing anchoring by virtue of the material penetrating into said strips.

Figure 8:
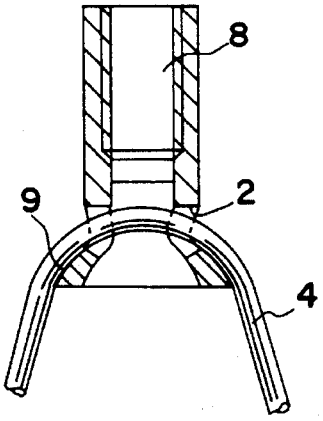
FIGS. 8 and 9 are respectively a front view and a side view of another embodiment.
Figure 9:
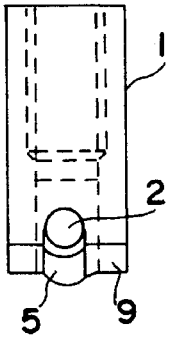

The implant of the invention maybe solid, obtained by molding, forging, or machining, or else it may be hollow and essentially constituted by a tube as shown in FIGS. 8 and 9. In this case, the top end of the shank 1 may have a tapped hole 8, for example, with the base of the anchor 3 being constituted by a flare 9 of the tube which, as before, supports the reinforcing bar 4 over an adequate portion of its length, said bar 4 passing, as before, through the eye 2. The curvature of the flare 9 is such as to correspond exactly with the curvature of the iron 4 so as to hold it securely when traction is applied to the sleeve 1.

Figure 10:
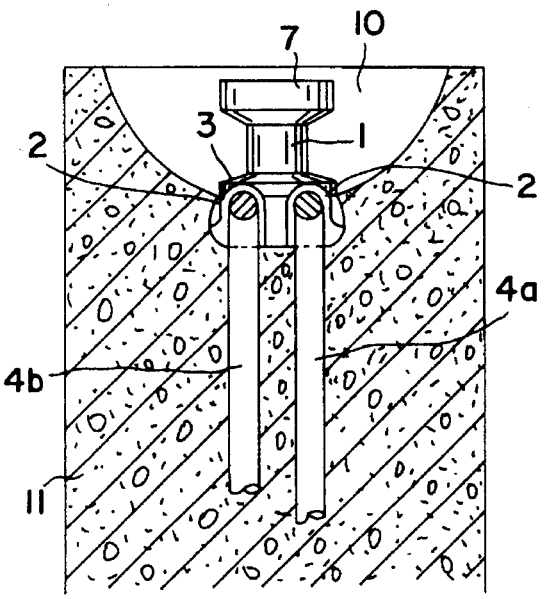
FIGS. 10 and 11 are a front view and a side view of an anchor engaged with two reinforcing bars having different angles of curvature.
Figure 11:
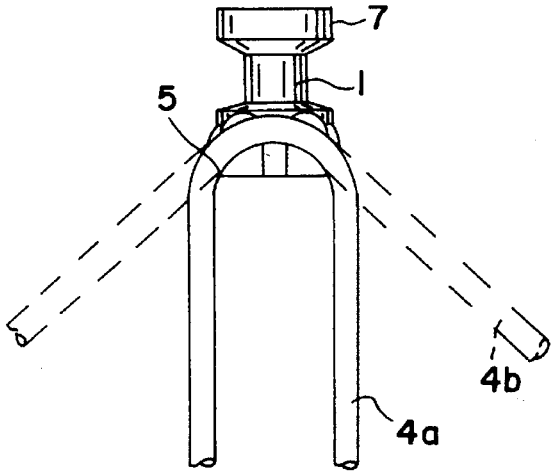

FIGS. 10 and 11 are respectively a front view and a side view of an anchor in a thin panel. FIG. 10 shows an anchor such as that shown in FIG. 6 enabling two different bars **4*a* and 4*b* to pass therethrough, the bars occupying two parallel vertical planes. As can be seen in FIG. 10, the head 7 projects into a recess 10 provided in the panel 11. However, according to a characteristic of the invention, the reinforcing bars 4*a* and 4*b* may extend at different angles in the two parallel planes, with the curvature of the two strips 5** then being identical or different. The reinforcing bars can thus be better distributed within the panel, thereby increasing safety.

Figure 12:
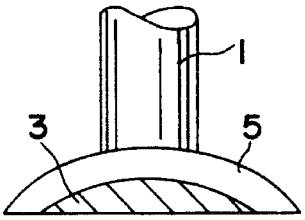
FIGS. 12 to 14 are a front view, a vertical section, and a plan view of a two-strip anchor base in accordance with a variant of the invention.
Figure 13:
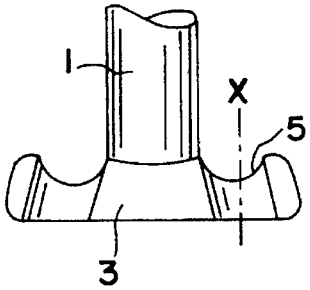
Figure 14:
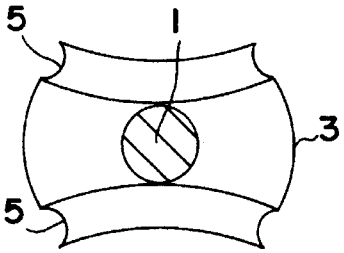

FIGS. 12, 13, and 14 show another embodiment of an anchor base 3, in which the strips 5 are offset from the shank 1 and may be straight or sloping according to requirements. I.e. the planes containing the axes X of the strips may either be parallel to the axis of the anchor or else they may be inclined relative to said axis.

For an implant having two reinforcing irons, the irons may be fixed within the implant by crimping, for example, thereby obtaining an assembly which is rigid, and easy to put into place prior to casting the panel-constituting material. An implant with a plurality of support strips serves to spread forces within the element, and this is advantageous, particular if its strength is very low, e.g. concrete which has not yet reached it final compression strength. A very short implant with a plurality of reinforcing irons designed for handling very thin slabs may also be used on the edges of the elements for the purpose of lifting them and handling them vertically. The support strips 5 may be made of one or two pieces that are added to the implant by crimping or welding, or else they may be made by deforming the implant.

Figure 15:
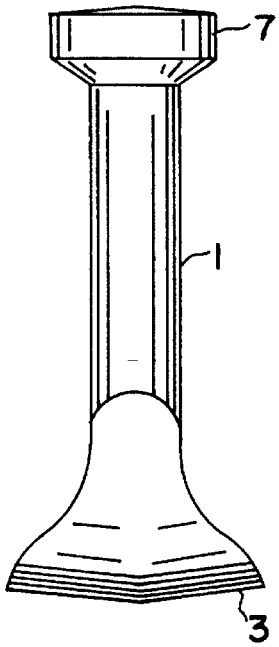
FIG. 15 is a front view of another embodiment of the anchor piece of the invention.
Figure 16:
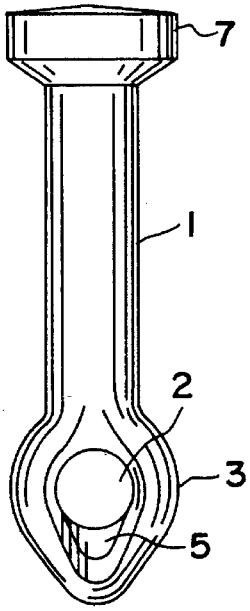
FIG. 16 is a side view of the anchor shown in FIG. 15.
Figure 17:
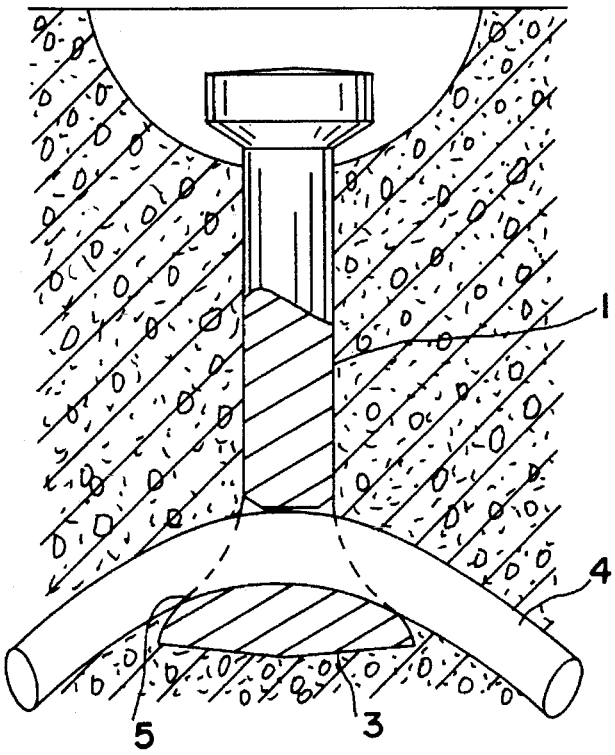
FIG. 17 is a side view of the anchor shown in FIGS. 15 and 16 depicting a reinforcing iron in place.

In an additional, preferred embodiment, a ramp anchor is shown in FIGS. 15, 16 and 17. The base 3 is laterally oversized in either direction of a center of shaft 1. Eye 2, residing within base 3, defines extended parabolic ramp 5. Extended parabolic ramp 5 is adapted to support iron 4 when iron 4 is seated within eye 2. The extension to base 3, and consequently to ramp 5, increase the contacting surface between ramp 5 and bar 4 as compared to other embodiments of the invention. The increased contacting surface limits or prevents any deformation likely to occur to the anchor or bar 4 under any traction force applied to head 7. By limiting or preventing deformation of the component parts of the invention, corresponding cracking or breaking of the anchored concrete is prevented or limited.

As compared to prior art "eye" designs, the preferred ramp anchor depicted in FIGS. 15–17 and described above exhibited a 17% increase in strength. That is, 17% more force was required to break the rods. Plastic deformation at the rods occurred at 30 KN for the new ramp anchors and only 15 KN for the old "eye" anchors.

Anchoring pieces of the invention may be obtained by conventional manufacturing methods and they may either be unitary, or else they may include items which are added on by welding or brazing, and in particular the base provided with its strips may be added to a forged shank.

The conical shape of the base, particularly when hollowed out since material can then penetrate into the hollow, serves to counterbalance lateral forces which maybe applied by a hoist while lifting a panel. In order to lift thin elements, with the implant disposed in the edge thereof, a connection (e.g. by welding) between the implant and the reinforcing iron can prevent any hinge action occurring, thereby limiting cracking during hoisting.

Naturally numerous variants may be envisaged, in particular by substituting technically equivalent means, without thereby going beyond the scope of the invention.

We claim:

1. An anchoring piece for hardenable material, the piece comprising:

a cylindrical head for remaining outside the material, said head forming a widened part of the anchor shank thereby providing a means to be grasped;

a solid shank having an axis of symmetry;

a base having an upper surface wider than the cross section of the shank, wherein the head, the shank and the base are unitary and formed from one piece of material; and, at least one continuous curved ramp having a substantially circular radius formed on said upper surface of the base, said ramp being shaped to define a contacting surface for receiving a reinforcing bar contacting and supported by said contacting surface, said ramp being flared downward and outward at opposing ends, the diameter and curvature of the ramp being substantially equal to the diameter and curvature of the reinforcing bar and wherein the anchoring piece is disposed directly within and contacts the hardenable material whereby relative displacement of the anchoring piece and said reinforcing bar are prohibited to prevent cracking of said hardenable material.

2. The anchoring piece of claim 1, wherein the base is pierced immediately above the ramp by at least one eye, said eye extending in a direction substantially perpendicular to the axis of symmetry and parallel to the contacting surface.

3. The anchoring device of claim 2, wherein the base has a pair of lateral extensions, said lateral extensions having an upper surface in which is formed the contacting surface.

4. The anchoring piece according to claim 1, further comprising two contacting surfaces formed on said upper surface of the base.

5. An anchoring arrangement for hardenable material comprising in combination: an anchoring piece having a head remaining outside the material, said head forming a means to be grasped; a shank having an axis of symmetry; a base having an upper surface wider than the cross section of the shank, wherein the head, shank and base are unitary and formed from one piece of material; at least one continuous ramp having a substantially circular radius formed on said upper surface of the base, said ramp defining a contact surface, and a curved reinforcing bar, said reinforcing bar and said contact surface being complementarily shaped so that the contact surface contacts and supports the reinforcing bar, and wherein the anchoring piece is disposed directly within and contacts the hardenable material, said ramp prohibiting relative displacement of the anchoring piece and reinforcing bar to prevent cracking of said hardenable material.

6. An anchoring piece for hardenable material, the device comprising:

a head for remaining outside the material, said head forming a widened part of the anchor shank, forming a means to be grasped;

a solid shank formed from a same piece as the head, having an axis of symmetry;

a base formed from the same piece as the head and the shank, having a pair of lateral extensions, said lateral extensions having an upper surface in which is formed a ramp having a substantially circular radius, said ramp being flared downward and outward at opposing ends, the diameter and curvature of the ramp being shaped to provide a contacting surface to contact and support a complimentarily shaped reinforcing bar, and wherein the anchoring piece is disposed directly within and contacts the hardenable material whereby relative displacement of the anchoring piece and said reinforcing bar are prohibited to prevent cracking of said hardenable material.

7. An anchoring piece in combination with a reinforcing bar and hardenable material, comprising:

a cylindrical head for remaining outside the material, said head defined by a wider part of the anchor shank, thereby forming a means to be grasped;

a solid shank formed from a same piece as said head, having an axis of symmetry, said shank disposed between said head and a base, said base being formed from a same piece as said head and the shank and having an upper surface larger than the cross section of the shank;

at least one continuous curved ramp having a substantially circular radius formed on said upper surface of the base, said ramp being flared downward and outward at opposing ends to define a curved contacting surface;

a reinforcing bar having a substantially circular radius and a curvature corresponding to said radius and said curvature of said ramp, whereby said reinforcing bar rests securely within said ramp on said contacting surface whereby relative displacement of said anchoring piece and reinforcing bar is prohibited; and, a hardenable material into which the integral anchoring piece and reinforce bar are disposed, said hardenable material directly contacting said anchoring piece and reinforcing bar whereby said hardenable material, when hardened, can be lifted by said anchoring piece, wherein cracking of said hardenable material during lifting is prevented.

* * * * *